US005168479A

United States Patent [19]

Lima

[11] Patent Number: 5,168,479

[45] Date of Patent: Dec. 1, 1992

[54] WATCH HAVING A REMOVABLE DIAL PLATE

[76] Inventor: Rui M. Lima, 599 Birch St., Fall River, Mass. 02724

[21] Appl. No.: 581,049

[22] Filed: Sep. 13, 1990

[51] Int. Cl.[5] ..... G04B 19/06

[52] U.S. Cl. ..... 368/232; 368/228

[58] Field of Search ..... 368/228, 232, 223

[56] References Cited

U.S. PATENT DOCUMENTS

| | | | |
|---|---|---|---|
| D. 224,550 | 8/1972 | Fainsibler et al. | 368/223 |
| 652,822 | 7/1900 | Voorheis | 368/223 |
| 1,024,558 | 4/1912 | Cornwell | 368/223 |
| 1,689,471 | 10/1928 | Andrusis | 368/223 |
| 3,156,990 | 11/1964 | Dock | 368/223 |
| 3,608,214 | 9/1971 | Rancati | 368/223 |
| 4,368,045 | 1/1983 | Kuh | 434/304 |

FOREIGN PATENT DOCUMENTS

| | | | |
|---|---|---|---|
| 0964451 | 7/1964 | United Kingdom | 434/304 |

*Primary Examiner*—Bernard Roskoski

[57] ABSTRACT

A wrist watch having a removable dial plate formed by four segmental sheets of material. Each segmental sheet can be a distinctly colored paper element having a thin transparent plastic film on it front face. The rear face of each segmental sheet can have a coating of a pressure-sensitive adhesive for bonding the sheet to the front face of the watch case. When it is desired to change the appearance of the watch dial plate the four segmental sheets can be removed and replaced with four other sheets having a different image or message on the sheet front faces.

1 Claim, 1 Drawing Sheet

FIG. 1

WATCH HAVING A REMOVABLE DIAL PLATE

This invention relates to wrist watches, and particularly to detachable dial plates for such watches. Each dial plate can be formed by four segmental sheets of material that can be removably attached to the front face of a watch to present a variety of different messages to the person wearing the watch or to other persons observing the watch.

In one form of the invention there are four segmental sheets of material arrangeable on the front wall of a watch to form a circular dial plate for the watch. Each sheet can be formed of a flexible paper material having indicia on its front surface, and a contact adhesive on its rear surface. A thin transparent plastic film can be laminated onto the front surface of the sheet to preserve the color and printing, and to give the sheet a glossy appearance.

Each segmental sheet is individually attached to the front wall of the case by pressing the rear surface of the sheet against the case front wall; the contact adhesive bonds the sheet to the case front wall.

In practice of the invention four segmental sheets will be used together to cooperatively form a visual message. Various different messages can be formed, e.g. a picture of an animal, or the alphabet, or a map, or a multiplication table, or a picture of the American flag, or a photograph of a person, or an inspirational message such as "Peace and Freedom for Everyone". Each one of the four segmental sheets will contain a portion of the visual message; when the four sheets are arranged on the front wall of the watch the entire message will be visible through a transparent cover that is removably attached to the watch case.

There will be different sets of sheets (four segmental sheets per set); each set of sheets will form a different visual image. The sets of sheets will be interchangeable, such that one set of sheets can at any time be removed from the front wall of the watch and replaced with a different set of sheets (to present a different visual image).

THE DRAWINGS

DESCRIPTION OF A PREFERRED EMBODIMENT OF THE INVENTION

Figure 1:
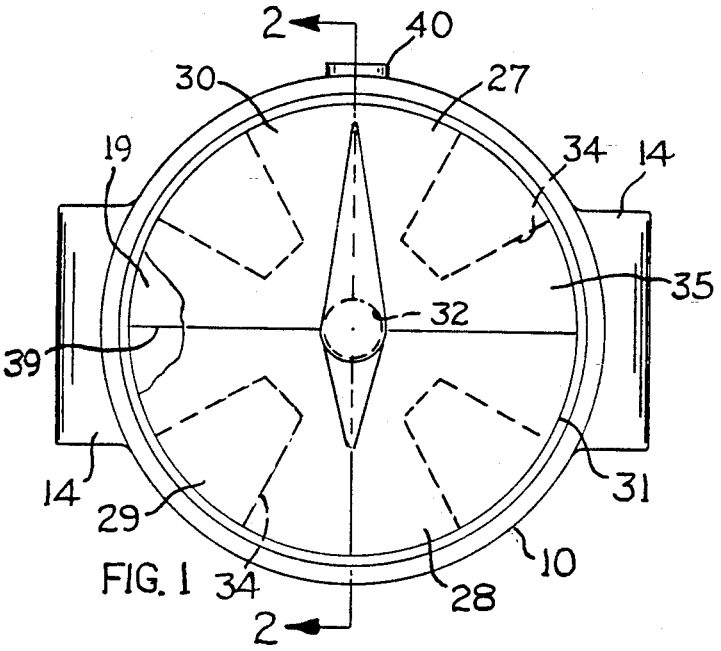
FIG. 1 is a front view of a watch embodying the invention.
Figure 2:
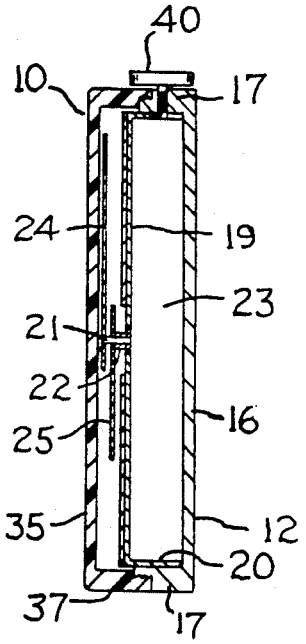
FIG. 2 is a sectional view taken on line 2—2 in FIG. 1.

The drawings show a watch 10 that includes a generally circular case 12 having two ears 14 extending therefrom for attachment of the watch to wrist bands, not shown. The case includes a generally circular back wall 16 and a peripheral edge wall 17 extending forwardly from wall 16; ears 14 extend laterally from edge wall 17.

The case further includes a generally circular front wall 19 having a peripheral flange 20 telescoped into peripheral edge wall 17 to space front wall 19 forwardly away from back wall 16. The space 23 between walls 16 and 19 will contain a conventional watch movement, that may be battery-operated or spring-operated. The watch movement includes two concentric shafts 21 and 22 extending through wall 19 on its central axis. A minute hand 24 is suitably attached to shaft 21, and an hour hand 25 is suitably attached to shaft 22.

Figure 3:
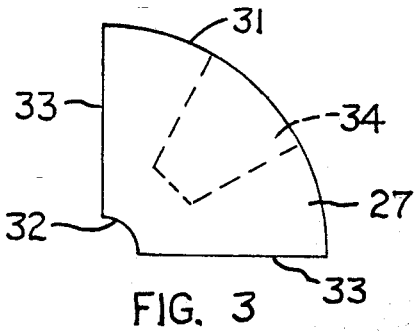
FIG. 3 is a plan view of a segmental sheet that can be used in the FIG. 1 watch.

Arranged on the front face of wall 19 are four segmental informational sheets 27, 28, 29 and 30. Each segmental sheet has an outer circular edge 31, an inner circular edge 32, and two radial edges 33 extending between the inner and outer edges. FIG. 3 shows one of the segmental sheets detached from the watch case. The other three segmental sheets will have the same shape as the sheet depicted in FIG. 3. When the four segmental sheets are arranged on the front face of case front wall 19, with their radial edges in edge-to-edge contact, the sheets will cooperatively cover the entire case front wall (except for a central portion of wall 19 bordering the two shafts 21 and 22).

Each segmental informational sheet 27, 28, 29 or 30 is preferably formed of a flexible sheet of paper having indicia printed on its front surface; the indicia can be of various different colors and configurations. A thin transparent plastic film is laminated onto the front surface of each sheet to seal the printed image against air contact. This will preserve the coloring against destructive aging. The plastic film will also tend to strengthen the paper sheet against tearing, especially while the sheet is being handled.

Each flexible paper sheet has a rear surface thereof coated with a contact (pressure-sensitive) adhesive. This adhesive covers most of sheet rear surface. However, a radially extending section 34 of the sheet rear surface is left free of the adhesive.

Watch 10 includes a transparent plastic cover 35 having a peripheral flange 37 that has a screw thread on its interior surface. Edge wall 17 of case 12 has a cooperating external screw thread adapted to mesh with the thread on flange 37 for removably attaching cover 35 to the watch case. The cover will be unscrewed from the case whenever it is desired to install or remove the informational sheets 27, 28, 29 and 30.

The left (exposed) face of case front wall 19 preferably has four radial lines printed thereon. In FIG. 1 portions of two of the informational sheets are removed to show one of the four radial lines printed on the front face of wall 19; the printed line is designated by numeral 39.

The four radial lines on wall 19 serve as locator devices for a radial edge 33 of at least the first segmental sheet to be installed on wall 19. Each segmental sheet can be installed onto wall 19 by gripping the adhesive-free portion 34 of the sheet with a needle-nosed pliers, and pressing the sheet against the left (front) face of wall 19, such that a radial edge 33 of the sheet is aligned with one of the radial lines printed on wall 19. After the radial edge area of the sheet is aligned with the printed line the sheet material is progressively pressed against wall 19, beginning with the aligned edge and moving toward the other radial edge 33.

The other three segmental sheets can be installed in a similar fashion, using a radial edge of the installed segmental sheet as a locator device. The needle-nosed pliers can be used to temporarily lift the segmental sheet from the face of wall 19 in the event that the sheet appears to be out of its proper position on wall 19.

After the four segmental sheets are attached to the front face of wall 19, the transparent cover 35 is screwed onto the watch case. Should it be desired to change the message or design on the watch dial, cover 35 can be unscrewed from the case, and the four existing segmental sheets removed from the exposed face of wall 19. A needle-nosed pliers can be inserted behind the adhesive-free portion 34 of the segmental sheet to obtain a grip on the sheet, sufficient to bend and pull the sheet away from the face of wall 19. A new set of four segmental sheets can then be installed onto wall 19, using the needle-nosed pliers as a positioner mechanism. As previously noted, there may be many different sets of segmental sheets, each set presenting a different message or visual image. The outer circumferential area of each segmental sheet will usually have the twelve hours of the day printed thereon.

The use of segmental sheets, as herein proposed, represents a relatively inexpensive way of changing the watch dial plate. Wall 19 and the two watch hands 24 and 25 remain in place during the process of changing the dial plate visual image. However, the two hands 24 and 25 should be rotated out of obstructive registry with each segmental space while the associated individual segmental sheet is being replaced. A conventional rotary knob 40 will be operably connected to the watch movement to set the two hands and to temporarily rotate them to non-obstruct positions.

The drawings show one specific form that the invention can take. It will be appreciated that the invention can be practiced in other forms.

What is claimed is:

1. An operating wrist watch comprising a case having a back wall, a front wall, and a peripheral edge wall extending from the back wall to the front wall;

a transparent front cover having a detachable connection to said peripheral edge wall;

a watch movement located within the case between its front wall and it rear wall; said watch movement including two concentric rotary shafts extending through the case front wall;

a minute hand attached to one of the shafts, and an hour hand attached to the other shaft between the case front wall and the transparent cover;

a plural number of flexible similarly-sized segmental-shaped information sheets removably attached to the case front wall, said sheets being similarly shaped and having edge contact with each other so as to cooperatively form a removable covering on the entire exposed face of the case front wall;

indicia on each information sheet, the indicia on the various sheets being coordinated to form a visual message when the flexible sheets are arranged on the case front wall;

each flexible sheet having a rear surface presented to the case front wall, and a contact adhesive on the sheet rear surface for removable attachment of the sheet to the case front wall;

each said flexible sheet comprising a paper sheet element and a film of transparent flexible plastic laminated to one face of the paper sheet element; said contact adhesive being located on the other face of the paper element;

a series of radial sheet alignment lines formed on the case front wall; each sheet alignment line serving as a locator device for a radial edge of an associated segmental-shaped sheet; the contact adhesive on each sheet rear surface covering only a portion of the sheet rear surface, leaving a radially extending section of the sheet rear surface free of adhesive, whereby a gripper tool can be engaged with the adhesive-free surface to facilitate installation of the sheet on the case front wall.

* * * * *